US010266314B2

(12) United States Patent
Haglof

(10) Patent No.: US 10,266,314 B2
(45) Date of Patent: Apr. 23, 2019

(54) CONSTRUCTION MATERIAL TUBE STRAP CAP

(71) Applicant: Philip D. Haglof, Sagamore Beach, MA (US)

(72) Inventor: Philip D. Haglof, Sagamore Beach, MA (US)

(73) Assignee: Philip D. Haglof, Sagamore Beach, MA (US)

( * ) Notice: Subject to any disclaimer, the term of this patent is extended or adjusted under 35 U.S.C. 154(b) by 0 days.

(21) Appl. No.: 15/847,396

(22) Filed: Dec. 19, 2017

(65) Prior Publication Data

US 2018/0178954 A1 Jun. 28, 2018

Related U.S. Application Data

(60) Provisional application No. 62/439,138, filed on Dec. 26, 2016.

(51) Int. Cl.
*B65D 47/12* (2006.01)

(52) U.S. Cl.
CPC ..... *B65D 47/12* (2013.01)

(58) Field of Classification Search
CPC ..... B65D 47/12
USPC ..... 222/386, 175, 545, 325
See application file for complete search history.

(56) References Cited

U.S. PATENT DOCUMENTS

| | | | | |
|---|---|---|---|---|
| 6,293,226 | B1 * | 9/2001 | Hwang | A01K 7/06 119/72 |
| 6,880,717 | B1 * | 4/2005 | O'Conor | B65F 1/1615 220/315 |
| 7,103,944 | B2 * | 9/2006 | Johnson | A47J 36/06 220/315 |
| 8,459,487 | B2 * | 6/2013 | Sharma | B65F 1/1615 220/315 |
| 2004/0065666 | A1 * | 4/2004 | Walker | B65F 1/1615 220/315 |
| 2005/0103790 | A1 * | 5/2005 | Masso | A45C 13/10 220/315 |
| 2007/0227929 | A1 * | 10/2007 | Mauerhan | A45C 11/16 206/488 |
| 2008/0169289 | A1 * | 7/2008 | Dawn | B65F 1/1615 220/315 |
| 2010/0193549 | A1 * | 8/2010 | Sirkis | B01L 3/0217 222/386 |
| 2011/0011858 | A1 * | 1/2011 | Vizl | B44D 3/006 220/23.86 |
| 2012/0085786 | A1 * | 4/2012 | Mamiye | B65D 35/30 222/386 |

(Continued)

*Primary Examiner* — Donnell A Long
(74) *Attorney, Agent, or Firm* — Kurt Rauschenbach; Rauschenbach Patent Law Group, LLP

(57) ABSTRACT

A construction material tube strap cap includes a base comprising a first and second tab that defines a respective first and second aperture, where the base is dimensioned to fit over a nozzle of a construction material tube. An upper section attached to the base. The upper section comprises a top surface and a bottom surface and is dimensioned to provide a seal around the nozzle with a predetermined volume surrounding the nozzle. An elastic strap is positioned through the first and second apertures defined in the first and second tabs in the base. The elastic strap has a length and an elasticity that cause the first and second tabs to flex inward toward the nozzle.

20 Claims, 4 Drawing Sheets

(56) References Cited

U.S. PATENT DOCUMENTS

| | | | | |
|---|---|---|---|---|
| 2013/0032241 | A1* | 2/2013 | Yamaguchi | B05C 17/00579 141/2 |
| 2013/0082132 | A1* | 4/2013 | Gaul | B65D 19/20 242/171 |
| 2013/0134188 | A1* | 5/2013 | Terakawa | B05C 17/00576 222/386 |

* cited by examiner

CONSTRUCTION MATERIAL TUBE STRAP CAP

CROSS REFERENCE TO RELATED APPLICATION

The present application is non-provisional application of U.S. Provisional Patent Application Ser. No. 62/439,138, entitled "Construction Material Tube Strap Cap", filed on Dec. 26, 2016. The entire contents of U.S. Provisional Patent Application Ser. No. 62/439,138 is herein incorporated by reference.

The section headings used herein are for organizational purposes only and should not to be construed as limiting the subject matter described in the present application in any way.

INTRODUCTION

Various types of viscous materials, such as caulking material, sealants, and adhesive materials are commonly sold in standard cylindrical cartridges with standard nozzles that dispense the viscous material. These types of viscous materials are referred to herein as viscous construction materials. These standard cylindrical cartridges have a substantially rigid outer shell and the nozzle at one end. A moveable member or plunger device is typically located at the other end opposite to the nozzle. When the moveable member or plunger device is translated toward the nozzle, pressure builds up inside the cylindrical cartridge that forces the viscous construction material out of the nozzle.

Caulking guns comprise a class of construction and repair tools that expel viscous construction materials such as caulk, sealant or other fill material from these standard cylindrical cartridges for the purpose sealing and waterproofing joints that are likely to crack if filled with a rigid, non-flexible material. For example, during caulking, a bead of caulk is extruded from the caulking gun onto the desired location. Soon after the caulk has been applied, the user generally smooths and shapes the caulk with either his or her finger or one or more shaping tools. The nozzle has an opening through which the viscous construction materials pass, and the nozzle and opening are typically shaped to provide a suitable volume and dimension of material on the desired surface.

Numerous types of caulking guns have been developed over many decades that hold the cylindrical cartridges in place so that an actuator can actuate the moveable member or plunger device to cause a pressure build-up in the cylindrical tube that is sufficient to dispense the viscous materials out of the nozzle on demand. The first type of caulking gun is a bulk dispensing gun which is a complete unit unto itself, containing a closed cylindrical chamber or shell with nozzle and actuating means. For example, U.S. Pat. No. 2,587,683 to Barry discloses a disposable-type caulking gun that includes a tubular container that is adapted to carry an ejection key and a nozzle. The ejection key is threaded into the back of the container and is used to drive an internal plunger to expel the viscous material through the nozzle at one end of the cylindrical container.

The second type of caulking gun is one that has an open framed supporting structure with an actuating mechanism that is designed to be used with a separate cartridge that has its own nozzle and a moveable member or plunger device that cause a pressure build-up in the cylindrical tube that is sufficient to dispense the viscous materials on demand. This, more modern type of caulking gun, is designed to be used with a standard disposable cartridge. The use of disposable cartridge for dispensing many types of viscous construction materials is now very common. There are many hundreds of different types of disposable cartridges in an industry standard form factor that are commonly available today for dispensing numerous types of viscous construction materials. Many hardware stores have entire or nearly entire aisles filled with such disposable cartridges of viscous construction materials.

A more modern caulking gun that embodies this second type of caulking gun with an open framed supporting structure and an actuating mechanism that is used with a separate disposable cartridge is disclosed in U.S. Pat. No. 5,137,184 to Jackson et al. The Jackson caulking gun includes an open framework that has a forwardly disposed rim member and a rearwardly disposed trigger actuating mechanism operative on a piston. Some caulking guns with open-framed supporting structures use racketing-type actuating mechanisms.

A nozzle is removably mounted on the top rim of the gun and is also operatively connectable to a disposable cartridge which is inserted into the gun and cooperative with a piston to dispense caulking or other viscous construction materials through the nozzle. The nozzle has a cone-shaped configuration. In more recently manufactured caulking guns with disposable cartridges, the nozzle is integrated directly into the disposable cartridge.

BRIEF DESCRIPTION OF THE DRAWINGS

The present teaching, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teaching in any way.

DESCRIPTION OF VARIOUS EMBODIMENTS

Figure 1A:
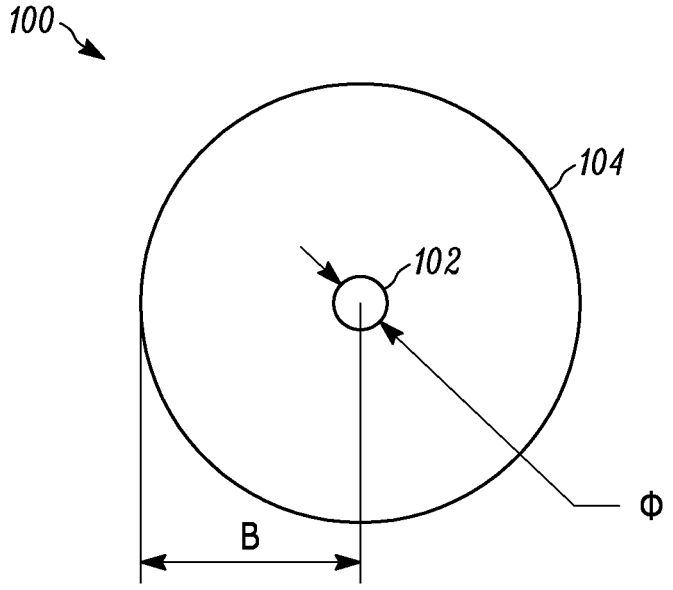
FIG. 1A illustrates a top-view of one embodiment of a body of a construction material caulking tube strap cap according to the present teaching.

The present teaching will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teaching herein will recognize additional implementations, modifications, and embodiments, as well as other fields of use, which are within the scope of the present disclosure as described herein.

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings can be performed in any order and/or simultaneously as long as the teaching remains operable. Furthermore, it should be understood that the apparatus and methods of the present teachings can include any number or all of the described embodiments as long as the teaching remains operable.

It is well known that exposing viscous construction material to air will cause solvents in the viscous construction material to evaporate thus reducing the percentage of solvents in the viscous construction material. Reducing the percentage of solvents in the viscous construction material will increase the viscosity of the viscous construction material. An increase in viscosity increases the resistance to flow of the viscous construction material, thereby making it more difficult to expel the viscous construction material from the nozzle. Increasing viscosity also makes it more difficult to work with the viscous construction material in many construction applications. Eventually, the viscosity of the viscous construction material reaches a level that will clog a nozzle normally used to apply the construction material. Even if the nozzle is cleared of the clog, the viscous construction material quickly becomes unusable because it cannot be acceptably applied to the work surface.

The time that it takes the viscous construction material to become unusable varies depending on many factors, such as the type of viscous construction material and solvents used in the viscous construction material, the cylindrical tube construction, and the environmental conditions. However, this time that it takes the viscous construction material to become unusable is relatively short and can be a few hours to a few days depending on the various factors. Consequently, the casual user of viscous construction material typically gets only one, or a few, uses out of the standard cylindrical tube with a standard nozzle. For many applications, this means that a large portion of the viscous construction material in the cylindrical tube is wasted because a large enough fraction of solvents evaporate before the remaining material is used.

Thus, one significant problem with the industry standard cylindrical disposable cartridges with nozzles that are widely used today is that, after their first use, they rapidly lose solvents and degrade to the point that they are not usable. For many casual users, the solvent instability results in the product being a single use product where much of the contents of the cylindrical disposable cartridge with nozzles are discarded.

Many industry standard cylindrical disposable cartridges come with a nozzle cover that fits over the nozzle after use for storage. Such nozzle covers are intended to prevent the viscous construction material from being exposed to air. However, nozzle covers for cylindrical tubes of viscous construction material with nozzles typically do not provide a good seal and/or they leave enough air volume between the nozzle and the cover that dries out the material in the nozzle causing a clog of the nozzle. The lack of a good seal causes solvent leaks and material leaks. Prior art nozzle covers have no mechanism or only a weak mechanism to secure them in place over the nozzle. As a result, prior art nozzle covers are notoriously leaky causing significant inconvenience to the user.

Various prior art nozzle covers use a thin member that inserts down into the nozzle opening. These thin members easily become covered with the material, causing material loss and a mess when the nozzle cover is removed because the construction material is transferred out of the tube. Since most of the viscous construction materials are sticky materials and sometimes contain toxic materials, this leaking and external presence of material is highly undesirable. Leaked viscous construction materials often destroy clothing and tool bags and leave messy residues in vehicles and workshops that are difficult to clean up. This undesirable leaking can be exacerbated when environmental conditions, such as temperature and pressure, change. For example, leaving a cylinder of viscous construction material in a hot vehicle often exacerbates the leaking.

Some prior art nozzle covers utilize thin rubber balloons that are stretched over the tip of the nozzle. These prior art nozzle covers must be constructed from an elastic material that limits their integrity. The elastic material is prone to breakage if it is stretched to its limits. In addition, the elastic material is prone to getting pin-holes and larger tears that reduce the quality of the seal. The elastic material can also be structurally weakened by exposure to the construction materials. Another common limitation of prior art nozzle covers is that they do not extend fully to cover the entire length of the nozzle. This limits the strength of the seal that they provide. The more surface area of the inside of the cap that is in contact with the nozzle, the stronger the seal. The nozzle cap of the present teaching provides both a large area on the inside of the cap to cover the nozzle and to be in direct contact with the nozzle in order to produce a strong seal.

One aspect of the present teaching is the realization that the nozzle cap provided with many industry standard cylindrical disposable cartridges containing viscous construction materials is not effective in preventing solvent loss after the cartridges are open because prior art nozzles are not adequately secured to the nozzle or cylindrical cartridge. The nozzle cap of the present teaching provides a strap mechanism to secure the cap to the nozzle. The strap of the nozzle cap of the present teaching may be integrated into the cap to prevent strap loss.

The construction material tube strap cap of the present teaching can be used in connection with a nozzle that is connected to a disposable cartridge as well as a nozzle that is part of a caulking gun system. The term nozzle as used herein refers to either one or both of these types of nozzles and to other nozzles known in the art.

FIG. 1A illustrates a top-view of one embodiment of a body of a construction material tube strap cap 100 of the present teaching. In some embodiments, the body of the construction material tube strap cap 100 is formed from plastic. For example, the body of the construction material tube strap cap 100 can be formed of thermoplastic material including at least one of liquid crystalline polymer, polyethylene, polyamide, polycarbonate, polypropylene, polyphenylene sulfide, thermoplastic elastomer, copolyester elastomer, polystyrene, polyvinyl chloride, polytetraflouroethylene, and poly (methyl methacrylate). One skilled in the art will appreciate that numerous types of plastic materials having the desired mechanical and stability properties can also be used. These plastic materials can be embedded with a colorant. Various other embodiments of the body of the construction material tube strap cap 100 of the present teaching utilize one of numerous types of materials to form the body of the construction material tube strap cap 100. For example, the body of the construction material tube strap cap 100 may be formed of rubber or metal materials, depending on the particular application.

The body of the construction material tube strap cap 100 has a conical shape. Thus, when viewed from the top, the body of the construction material tube strap cap 100 has a small diameter, Ø, at the top 102 and a larger radius, B, at the bottom 104. In some embodiments, the top 102 and bottom 104 of the body of the construction material tube strap cap 100 are circular shape. The top 102 and bottom 104 of the body of the construction material tube strap cap 100 are dimensioned to provide a particular seal around the nozzle. The top 102 and bottom 104 of the body of the construction material tube strap cap 100 are also dimensioned to provide a particular predetermined volume of air surrounding the nozzle enclosed by the body of the construction material tube strap cap 100. In some embodiments, the volume around the nozzle is substantially zero.

In one particular embodiment, the top diameter is about Ø=0.0881 in, and the bottom radius is about B=0.36 in. In some embodiments, the top radius and bottom radius are dimensioned to allow the body of the construction material tube strap cap 100 to fit completely over a top nozzle. In some embodiments, the top radius and bottom radius are dimensioned to the fit over the top nozzle of a commercial cartridge with a snug fit, such that the construction material tube strap cap does not fall off the nozzle when inverted. In some embodiments, the top radius and bottom radius are dimensioned large enough so that the construction material tube strap cap fits completely over the majority of commercial cartridge nozzle dimensions. In some embodiments, the bottom radius is dimensioned such that the bottom 104 of the body of the construction material tube strap cap 100 fits tightly on a lower portion of the nozzle to hold the cap in place, while the top radius is dimensioned to fit loosely over the top portion of the nozzle.

One skilled in the art will appreciate that the body of the construction material tube strap cap according to the present teaching can have different shapes that are configured to fit over different nozzle shapes. For example, in some embodiments, the shape of the body of the construction material tube strap cap is a prism shape with a rectangular top and bottom. In some embodiments, the shape of the body of the construction material tube strap cap is a conical shape with an oval shaped top and bottom.

Figure 1B:
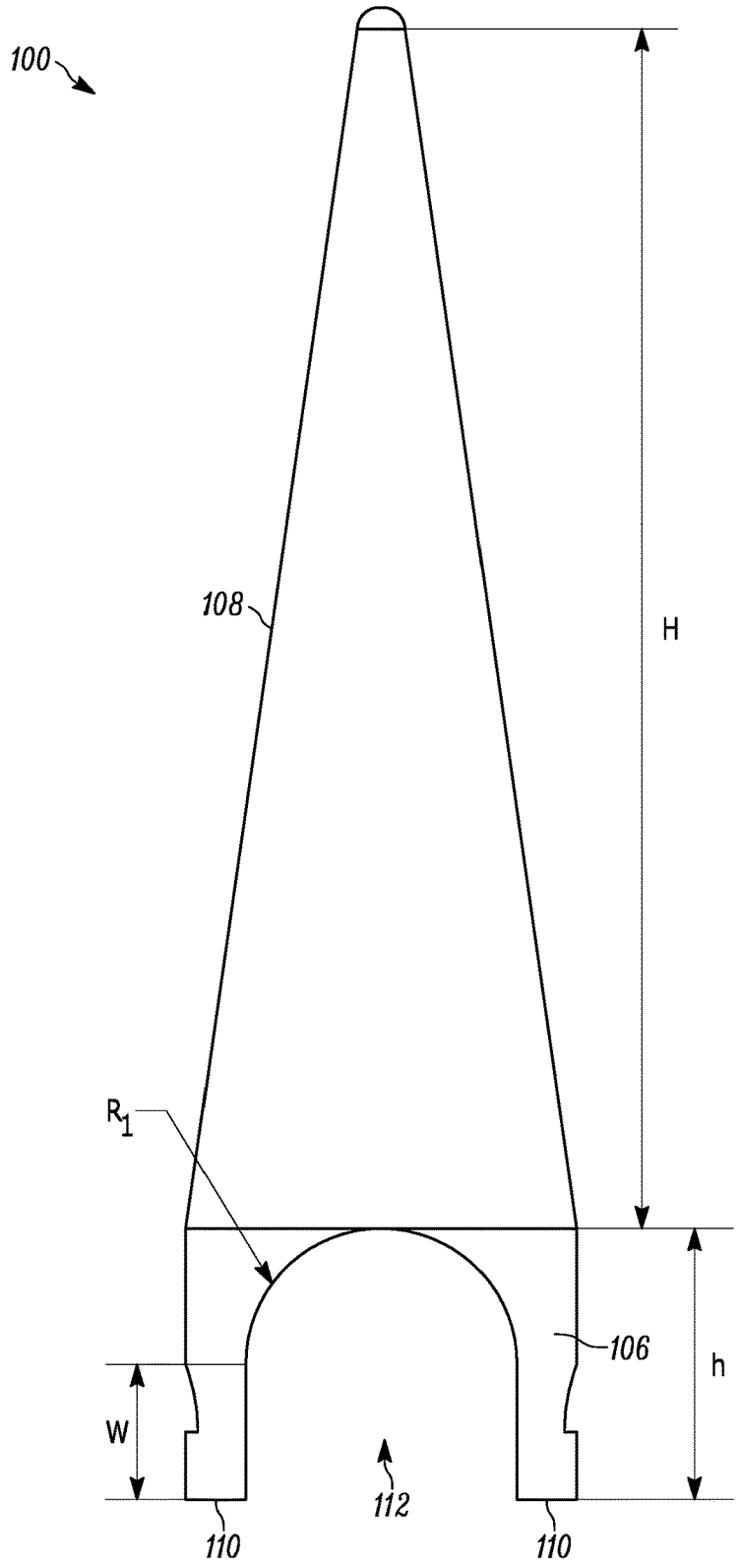
FIG. 1B illustrates a front-view of the body of the construction material tube strap cap according to the present teaching described in connection with FIG. 1A.

FIG. 1B illustrates a front-view of a body of a construction material tube strap cap 100 according to the present teaching described in connection with FIG. 1A. The body of the construction material tube strap cap 100 includes a base 106 and an upper section 108. The base 106 is designed to secure the body of the construction material tube strap cap 100 to the nozzle. The upper section 108 is designed to fit over a nozzle. The upper section 108 is dimensioned to provide a particular seal and predetermined volume in the region between the upper section 108 and the nozzle when the upper portion is placed over the nozzle. The upper section 108 has a height H. The base 106 has a height h. In some embodiments, the height of the upper section H is dimensioned to cover substantially the entire nozzle. In some embodiments, the total height H+h is dimensioned to cover substantially the entire nozzle. In some embodiments, the height of the upper section H is sized to cover only part of the nozzle. In one particular embodiment, the height of the upper body H is equal to about 2.2 inches and height of the base h is equal to about 0.5 inch.

The base 106 includes two tabs 110 that are located directly across from each other that form notches 112 in the base 106. The tabs 110 and notches 112 allow the base 106 to be tightened around a nozzle. In some embodiments, the notches 110 form an arch shape with a semi-circular portion that is positioned above flat walls at an edge of the tabs 110. The tabs 110 can flex inward to contact the nozzle to provide a secure fit. The arch provides strength at the top of the base 106 to prevent deformation, such as kinking and creasing of the upper section 108 of the body of the construction material tube strap cap 100, when a strap 116 (FIG. 1D) is used to flex the tabs 110 toward a nozzle. The arch is configured in a shape that allows the tabs 110 to have sufficient material for the desired strength and flexibility. In some embodiments, the semi-circular portion of the arch of notch 112 has radius $R_1$ that is positioned above flat walls, with height w. In one particular embodiment, the radius $R_1$ is equal to about 0.25 inches and the height w is equal to about 0.25 inches.

Figure 1C:
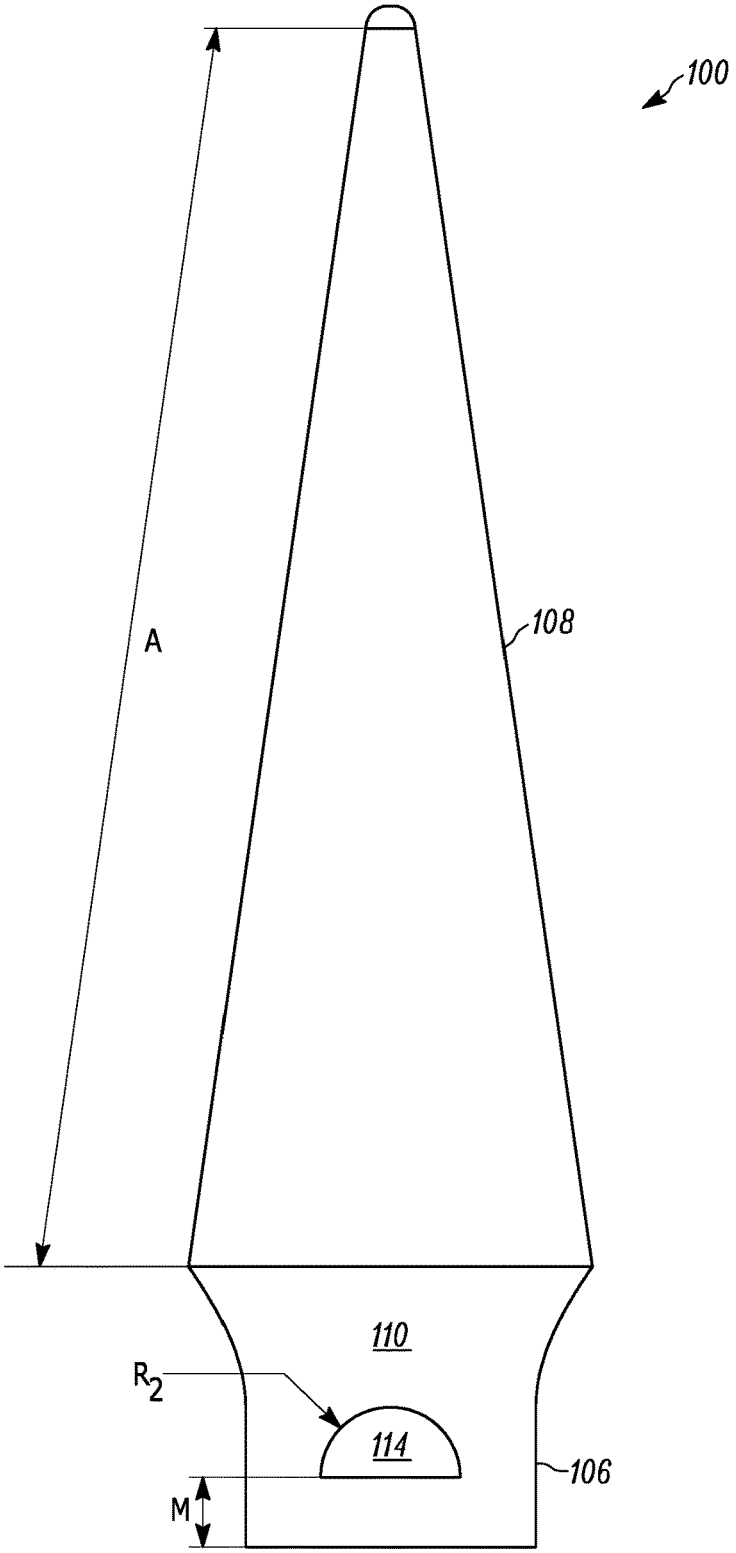
FIG. 1C illustrates a side-view of the body of the construction material tube strap cap according to the present teaching described in connection with FIG. 1A.
Figure 1D:
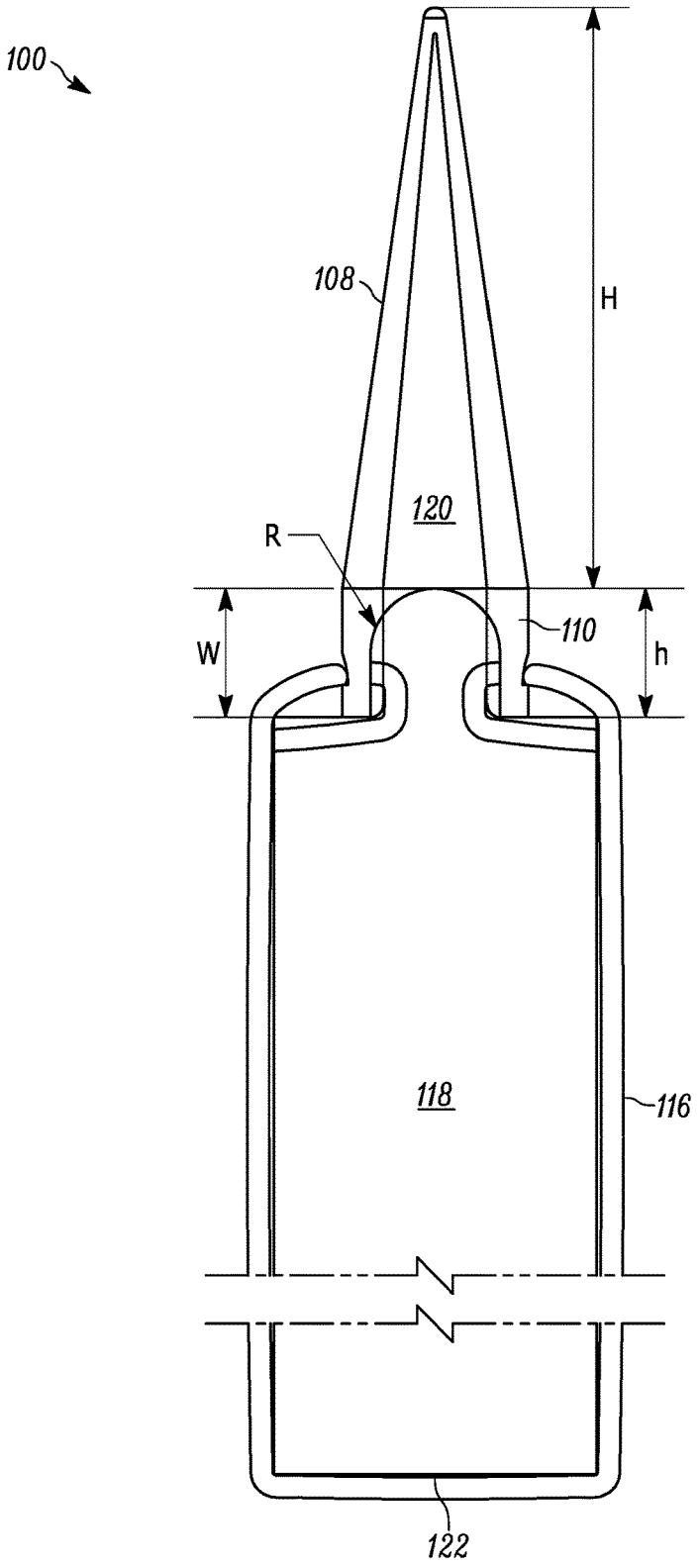
FIG. 1D illustrates an embodiment of a construction material tube strap cap of the present teaching positioned over a construction material tube.

FIG. 1C illustrates a side-view of the body of the construction material tube strap cap 100 according to the present teaching described in connection with FIG. 1A. FIG. 1C illustrates the base 106 and the upper section 108 of the construction material tube strap cap body 100. The sidewall of the upper portion 108 has a length A. In some embodiments, the length A is equal to about 2.23 inches. The tab 110 of the base 106 includes an aperture 114. The aperture 114 is position a distance M from the bottom end of the tab 110. The aperture 114 provides a space to insert a strap 116 (FIG. 1D). In some embodiments, the aperture 114 has a semi-circle shape with radius $R_2$. In some embodiments, M is equal to about 0.125 inches, and $R_2$ is equal to about 0.125 inches. In some embodiments, the tabs 110 of the base 106 comprise two parallel portions. In some embodiments, the distance between the parallel portions of the tabs 110 is dimensioned smaller than the bottom radius, B. This ensures that the tabs 110 engage the edge of the nozzle when they are flexed inward by the strap 116.

One feature of the present teaching is the ability to secure the construction material tube strap cap 100 to a nozzle using a simple, low-cost strap 116. FIG. 1D illustrates the construction material tube strap cap 100 positioned over a construction material tube 118 such as a caulking material tube. The nozzle 120 of the construction material tube 118 is positioned between the tabs 110. The strap 116 has a length and elasticity that allows it to cause the tabs 110 to flex inward toward the nozzle 120 when the strap 116 is positioned around a bottom 122 of a tube 118 of caulking or other viscous construction material. In various embodiments, the strap 116 is positioned to encircle all or part of a bottom 122 of the tube 118. In some embodiments, the strap 116 is an elastic band or similar elastic strap. The strap 116 passes through both of the apertures 114 to secure it to the construction material tube strap cap body 100.

In some embodiments, the strap 116 is dimensioned so that when it is positioned around the bottom 122 of the tube 118 it exerts enough force on the construction material tube strap cap to cause the tabs 110 to flex inward toward the nozzle 120. In this way, the strap 116 may be stretched over the nozzle 120 to place the construction material tube strap cap 100 over the nozzle 120, and, then tighten to flex the tabs 110 of the base 106 inward to make contact with the nozzle 120 to secure the construction material tube strap cap in place. The strap 116 is chosen with properties that hold the tabs 110 in place during storage.

In various embodiments, the strap 116 can be formed of one of numerous types of flexible or elastic materials, such as a synthetic rubber material, natural rubber, latex, or numerous other types of elastomers. In particular embodiments, the strap 116 is an elastic band or an O-ring. The strap 116 material can be formed of a synthetic rubber material, a natural rubber material or a latex material. The strap 116 material can also be formed of a stretch fabric material, such as spandex or elastane. The strap 116 material can also be formed a polyester or copolymer material. The strap material can also be formed of a natural fiber. The strap material can also be formed of a plastic or metal material. Those skilled in the art will appreciated that the strap 116 may take a variety of predefined shapes and be secured with a variety of mechanisms consistent with the present teaching. For example, the strap 116 can be a length of material that is simply tied in place or joined by numerous means known in the art. The strap 116 can also be a cable tie that is tightened and secured using a locking mechanism.

EQUIVALENTS

While the Applicant's teaching is described in conjunction with various embodiments, it is not intended that the Applicant's teaching be limited to such embodiments. On the contrary, the Applicant's teaching encompass various alternatives, modifications, and equivalents, as will be appreciated by those of skill in the art, which may be made therein without departing from the spirit and scope of the teaching.

I claim:

1. A construction material tube strap cap comprising:

a) a base comprising a first and a second tab that define a respective first and second aperture, the base being dimensioned to fit over a nozzle of a construction material tube;

b) an upper section attached to the base, the upper section comprising a top surface and a bottom surface, the upper section being dimensioned to provide a seal around the nozzle with a predetermined volume surrounding the nozzle; and c) an elastic strap positioned through the first and second apertures defined in the first and second tabs in the base, the elastic strap having a length and an elasticity that cause the first and second tabs to flex inward toward the nozzle.

2. The construction material tube strap cap of claim 1 wherein the first and second tabs are configured to form respective first and second arches with a semi-circular portion.

3. The construction material tube strap cap of claim 2 wherein the first and second arches formed by the first and second tabs are configured in a shape that allows the first and second tabs to have sufficient material for a desired flexibility.

4. The construction material tube strap cap of claim 2 wherein the first and second arches provides strength at the top of the base to prevent deformation of the upper section of the body.

5. The construction material tube strap cap of claim 1 wherein the upper section comprises a conical-shaped upper section having a top surface with a first radius and a bottom section with a second radius.

6. The construction material tube strap cap of claim 5 wherein the first radius of the top surface is less than 0.1 in.

7. The construction material tube strap cap of claim 5 wherein the second radius of the bottom surface is less than 0.4 in.

8. The construction material tube strap cap of claim 5 wherein the second radius of the bottom surface is chosen such that the construction material tube strap cap fits tightly on a lower portion of the nozzle.

9. The construction material tube strap cap of claim 1 wherein the upper section is formed in a circle shape with a circular top and a circular bottom.

10. The construction material tube strap cap of claim 1 wherein the upper section is formed in a prism shape with a rectangular top and a rectangular bottom.

11. The construction material tube strap cap of claim 1 wherein the upper section is formed with an oval-shaped top and an oval-shaped bottom.

12. The construction material tube strap cap of claim 1 wherein the upper section and the base are formed in one piece.

13. The construction material tube strap cap of claim 1 wherein the elastic strap is positioned through a center of both the first and second apertures.

14. The construction material tube strap cap of claim 1 wherein the elastic strap has a length that is selected to be long enough to encircle a portion of a bottom of the construction material tube.

15. The construction material tube strap cap of claim 1 wherein the elastic strap comprises an elastic band.

16. A method of sealing a nozzle of a construction material tube, the method comprising:

a) providing a base comprising a first and a second tab that define a respective first and second aperture and having dimensions that fit over a nozzle of a construction material tube; and having an upper section that is dimensioned to provide a seal around the nozzle with a predetermined volume surrounding the nozzle;

b) positioning an elastic strap through the first and second apertures defined in the first and second tabs in the base; and c) adjusting a length of the elastic strap so as to cause the first and second tabs to flex inward toward the nozzle thereby sealing the nozzle.

17. The method of claim 16 further comprising forming first and second arches in respective ones of the first and second tabs.

18. The method of claim 16 wherein the first and second tabs are configured in a shape that allows for a desired flexibility to seal the nozzle.

19. The method of claim 16 wherein the first and second arches prevent deformation of the upper section of the body.

20. The method of claim 16 further comprising adjusting a length of the elastic strap so that it encircles a portion of a bottom of the construction material tube.

* * * * *